United States Patent [19]

Kusmer

[11] 3,937,462

[45] Feb. 10, 1976

[54] EXERCISING DEVICE

[76] Inventor: Kasimir Kusmer, 1021 Cochran St., Aurora, Ill. 60506

[22] Filed: Aug. 15, 1974

[21] Appl. No.: 497,714

[52] U.S. Cl. ..... 272/83 R; 74/100 R; 272/79 R

[51] Int. Cl.[2] ..... A63B 21/00

[58] Field of Search ..... 272/79, 80, 81, 82, 83; 206/67 A, 67 B; 74/97, 100

[56] References Cited

UNITED STATES PATENTS

| | | | |
|---|---|---|---|
| 496,807 | 5/1893 | Wright | 200/67 B UX |
| 542,708 | 7/1895 | Johnson | 200/67 B UX |
| 1,236,133 | 8/1917 | Anderson | 200/67 A |
| 1,249,857 | 12/1917 | Thomas | 200/67 A |
| 1,293,532 | 2/1919 | Peck | 200/67 B UX |
| 1,443,485 | 1/1923 | Lewis | 200/67 B |
| 1,499,139 | 6/1924 | Arnold et al. | 200/67 B |
| 1,517,638 | 12/1924 | Kellner | 200/67 B |
| 1,666,925 | 4/1928 | Benjamin et al. | 200/67 B |

*Primary Examiner*—Paul E. Shapiro
*Attorney, Agent, or Firm*—Larson, Taylor & Hinds

[57] ABSTRACT

An exercising device employing the principle of isotonic exercise in conjunction with isometric exercise to improve and develop the muscular and bone structure of various parts of the human body. In two embodiments of the invention, the apparatus includes a first class lever which is pivotably mounted on a supporting structure in a manner which permits the lever to operate against a force resisting spring. The spring is capable of sudden disengagement from the lever thereby permitting the lever to travel freely under the influence of the applied operator force. The travel of the lever is positively impeded by a striking block which imparts an impact to the operator through the lever. In a third embodiment, the apparatus includes a biforcated third class lever having a spring mounted between the frame and the lever. The spring is brought into the greatest tension when the lever is in line with the spring and the spring's resistance is removed when the lever is rotated beyond the in line position with the spring. Once beyond the in line position, the spring tension aids the operator's force causing the lever to impact against an impact block. The invention thus provides a brief period of isotonic exercise instantaneously followed by a period of isometric impact exercise in the form of an impact.

22 Claims, 8 Drawing Figures

FIG. 1
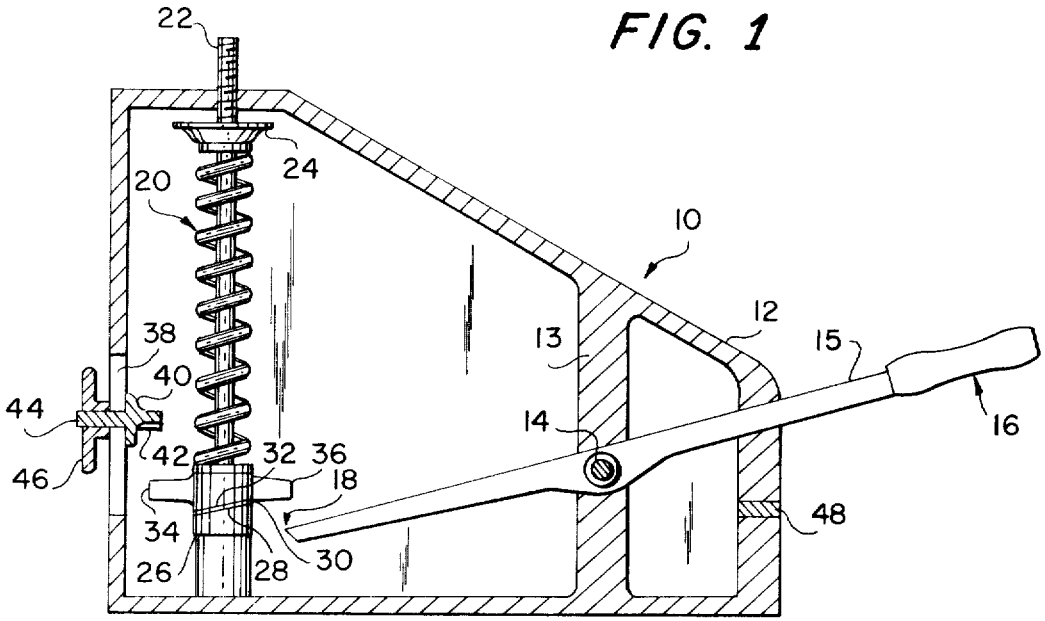
FIG. 2
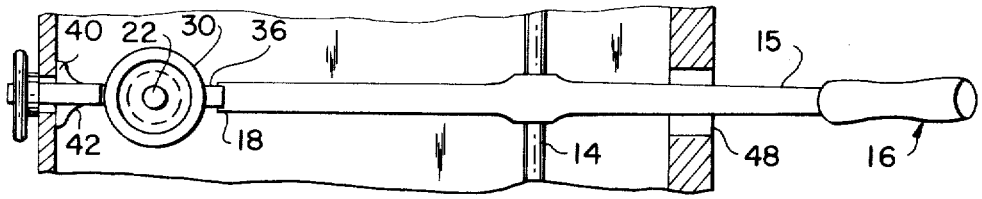
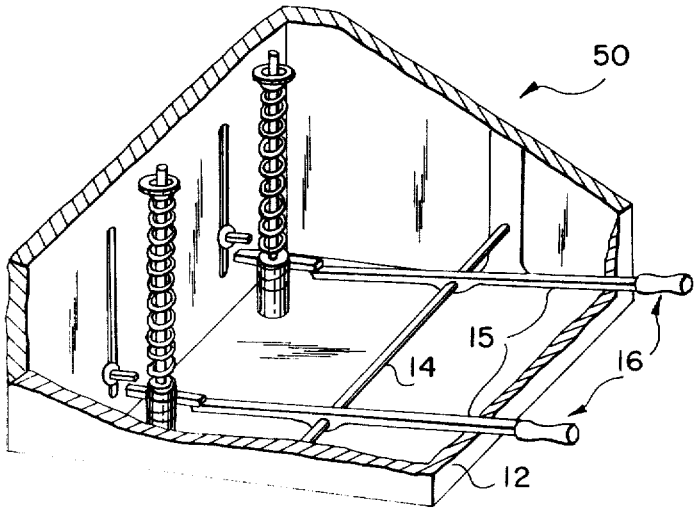
FIG. 3

EXERCISING DEVICE

BACKGROUND OF THE INVENTION

1. Field of the Invention

The present invention relates generally to exercising apparatus and more particularly to apparatus which include a spring for exercising the limbs.

2. Description of the Prior Art

Exercising apparatus which employ either isotonic exercise or isometric exercise are well known and conventional. Examples of isometric impact exercise devices in the prior art include conventional punching bags and the like, which permit exercise in the form of an impact to the operator. Other impact devices include the type utilizing a movable object constrained with a frame which is held by the operator. The impact is realized when the moving object strikes the frame and is transmitted to the operator. Devices of this type are disclosed in U.S. Pat. Nos. 2,871,017 and 3,545,121.

Isotonic exercise apparatuses are of the type which usually incorporate force resisting devices in the form of springs or suspended weights. Examples of this type of apparatus include the conventional barbell, elastic stretch devices similar to that disclosed in U.S. Pat. No. 3,662,602, and various static exercise devices of the type disclosed in U.S. Pat. Nos. 3,690,655 and 3,598,405.

However, there are very few, if any, exercising apparatuses in the prior art which combine both isotonic exercise and isometric impact exercise in a single device. In addition, many of the singular variety of exercising devices are expensive, too large for small apartments, not easily transported, and usually not adjustable.

SUMMARY OF THE INVENTION

The apparatus of the present invention provides a unique structure upon which exercises can be performed to develop and strengthen the musculate and bone structures of the limbs. The apparatus combines isometric impact exercising with isotonic exercising in order to obtain the benefits of both types of exercise. More particularly, the apparatus of the present invention includes a lever operable against a force resisting means up to a predetermined force, whereupon the lever is released from the force resisting means and allowed to travel freely until it engages a travel restricting means which impedes the travel of the lever. The operation of the lever against the force resisting means provides a period of isotonic exercise which is followed by the operation of the lever against the travel restricting means which provides a period of isometric impact exercise. In one embodiment of the invention, the strength of the force resisting means and the point of lever disengagement can be adjusted, thereby making both the strength and the duration of the isotonic exercise variable. Similarly, the period of free travel and the elasticity of the travel restricting means could be adjustable thereby making the strength and duration of the isometric impact exercise variable.

It is therefore an object of the invention to provide an improved apparatus, which although simple in construction, permits the user to exercise and develop the extremities of the body through the combination of isometric impact exercise with isotonic exercise. While the apparatus is designed primarily to exercise the limbs of the body, in doing so it will tend to strengthen and develop other parts of the human body such as the thorax or the abdomen.

A further object of the present invention is the provision of an exercise apparatus which may be used in limited quarters and which is simple and inexpensive.

These and other objects and advantages of the present invention will be discussed in, or apparent from, a consideration of the presently preferred embodiments set forth in the specification and claims hereinbelow.

BRIEF DESCRIPTION OF THE DRAWINGS

In the drawings:

FIG. 1 is a side elevational view of one embodiment of an exercising machine in accordance with the invention.

FIG. 2 is a fragmentary plan view of a trip mechanism used to release the lever from the force resisting spring.

FIG. 3 is a perspective view of a dual lever embodiment of an exercising machine in accordance with the invention, used to exercise both arms or both legs.

DETAILED DESCRIPTION OF PREFERRED EMBODIMENTS

Figure 4:
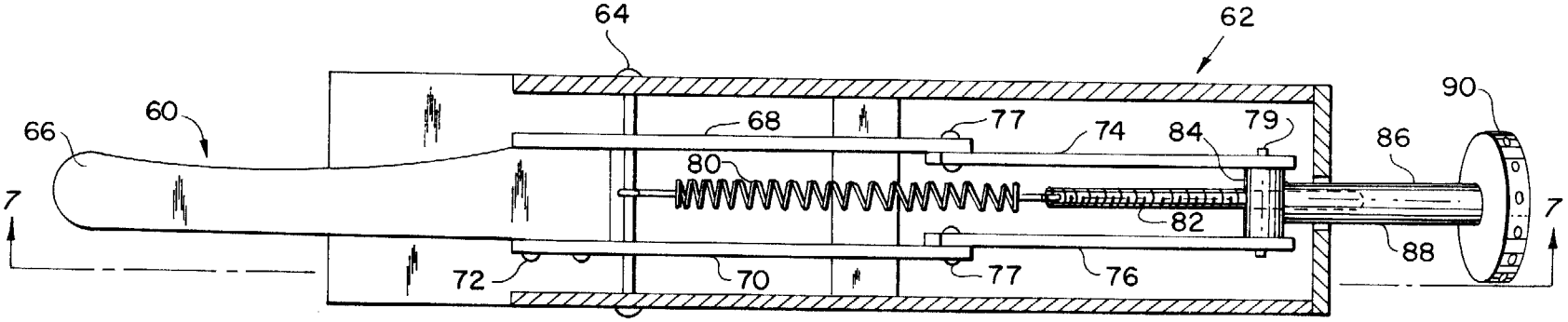
FIG. 4 is a top plan view of a further embodiment of an exercising machine in accordance with the invention.

Referring now to the drawings and particularly to FIGS. 1 and 2 thereof, there is shown an exercising machine generally designated 10 in accordance with the invention. Exercising machine 10 includes an elongated skeleton frame 12 having an inner vertical support member 13 extending between the top and bottom of frame 12. Pivotably attached to the mid portion of support member 13 at a pivot point or fulcrum 14 is a first class lever 15. One end of lever 15 extends longitudinally beyond frame 12 and has a handle 16 rigidly mounted thereon. The other end, denoted 18, of lever 15 terminates with a vertically inclined beveled surface located on the underside thereof.

Exercising machine 10 further includes an adjustable force resisting means such as a coil compression spring 20 concentrically mounted on a vertical supporting rod 24 which in turn is mounted on frame 12 proximate to end 18 of lever 15. The upper end of rod 22 is threaded and carries a pressure adjusting nut 24 which engages the upper end of spring 20 and can be positioned to increase or decrease the compression of spring 20. The other end of rod 22 has a collar 26 integrally mounted thereon and provided with a vertically inclined beveled surface 28. Concentrically mounted on rod 22 for rotational and axial movement is a cam 30, the lower end of which is provided with a beveled surface 32 which mates with and slidably engages beveled surface 28 of collar 26. The bottom of spring 20 engages with the upper surface of cam 30 so that upon axial movement of cam 30, spring 20 is compressed against the pressure adjusting nut 24.

Cam 30 also comprises a forward boss 34 and a rearward boss 36 extending substantially coaxially in a forward and rearward direction respectively. Rearward boss 36 extends rearwardly a sufficient amount so that it can be engaged with end 18 of lever 15 and upon rotation of lever 15 about fulcrum 14 will be raised axially upwardly thereby compressing spring 20.

The forward end of frame 12 is provided with a vertical slot 38 and a dog 40 rigidly mountable and vertically adjustable within slot 38. Dog 40 comprises a rearwardly extending portion 42, a forwardly extending screw portion 44 integral with portion 42, and a mounting nut 46. Portion 42 of dog 40 is provided with a vertically beveled plane for engaging a contra-beveled plane on boss 34 of cam 30 when cam 30 is vertically lifted to the height of dog 40.

At the rearward end of frame 12 is an impact block 48 integrally mounted on frame 12 at a vertical height not greater than the height of fulcrum 14. Impact block 48 extends in a transverse direction a distance sufficient so as to prevent any downward movement of lever 15 beyond the vertical height of block 48. In the embodiment depicted in FIG. 1, the vertical height of impact block 48 is the same as the vertical height of fulcrum 14 so that lever 15 will be substantially horizontal when it engages impact block 48.

In operation, exercising machine 10 is actuated by pressing in a downward direction against handle 16, thereby rotating lever 15 about fulcrum 14 in a clockwise direction. End 18 of lever 15 engages rearward boss 36 of cam 30 and upon continued clockwise rotation of lever 15 displaces cam 30 upwardly against the compressional force of spring 20. Eventually, as cam 30 is moved vertically upward about rod 22, forward boss 34 will engage dog 40 and continued upward movement of cam 30 will cause rotation thereof through the action of the contra-beveled surfaces on forward boss 34 and portion 42 of dog 40. At the point where cam 30 has been rotated sufficiently to disengage from end 18 of lever 15, the resisting force of the spring is removed and lever 14 is rapidly rotated downwardly until it engages with a sudden impact on impact block 48. This impact is transmitted to the operator through handle 16. As mentioned above, the compression of spring 20 can be adjusted with pressure adjusting nut 24 creating, for a greater compression, a greater impact delivered to the operator when lever 15 strikes impact block 48. In addition, the amount of free travel of lever 15 can be adjusted by the vertical positioning of dog 40 in a slot 38. Therefore, it can be seen that any combination of compression force and impact force can be obtained by varying the compression of spring 20 and the vertical travel of lever 15 after disengagement with cam 30.

Once lever 15 has been disengaged from cam 30, it can be easily reset by rotating handle 16 in an upward direction. When end 18 of lever 15 engages the upper portion of rearward boss 36, the cam surface on end 18 will rotate cam 30 out of engagement therewith, thereby permitting end 18 to be positioned below cam 30. If desired, rearward boss 36 of cam 30 can be provided with a vertical contra-beveled surface to the beveled surface of end 18.

FIG. 3 depicts a two lever exercising machine 50 in accordance with the present invention. Each lever system of exercising machine 50 is identical to single lever exercising machine 10 and therefore exercising machine 50 need not be described in greater detail.

Figure 5:
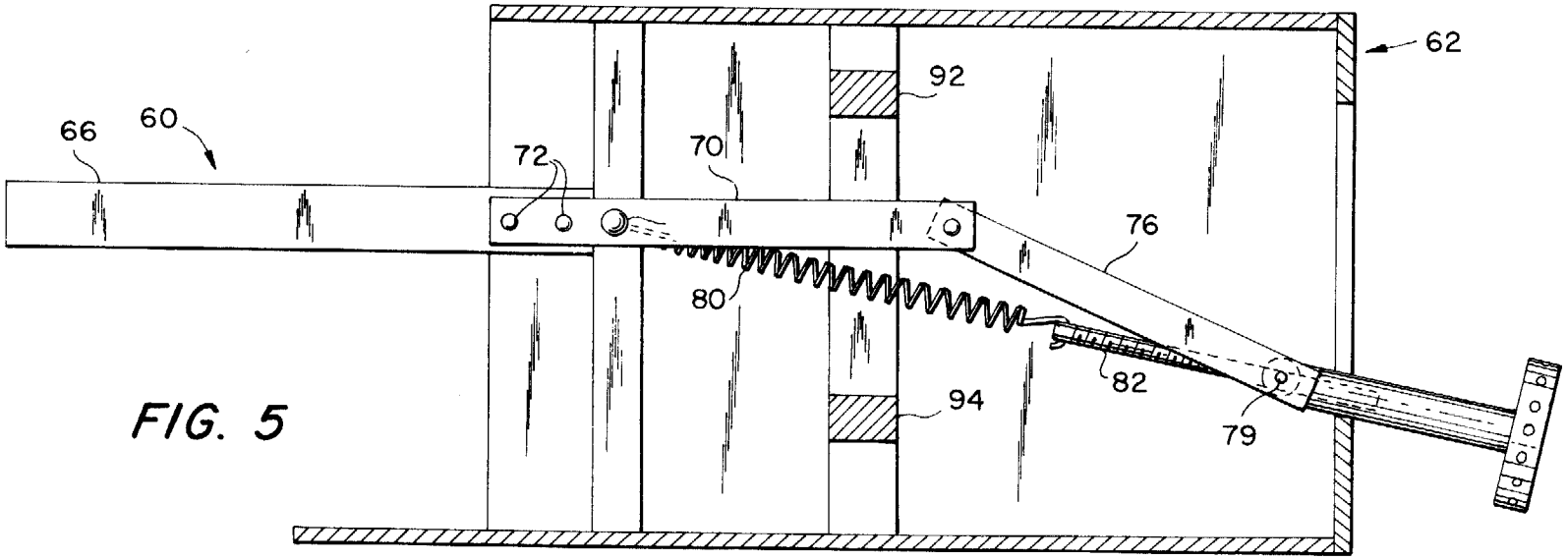
FIG. 5 is a side elevation view of the embodiment shown in FIG. 4.

A further embodiment of the present invention also employing a first class lever is depicted in FIGS. 4 and 5. A bifurcated lever 60 is pivotably mounted at a middle portion thereof to a frame 62 by a pin 64. Lever 60 comprises a handle 66, and two elongated members 68 and 70 rigidly mounted in a parallel arrangement to one end of handle 66 with bolts 72. Two connecting links 74 and 76 are pivotably mounted at pivot points 77 at one end thereof to members 68 and 70 respectively and are pivotably mounted to a crossbar 78 at the other end at a pivot point 79. The adjustable force resisting means comprises a coil spring 80 removably connected at one end to pin 64 and removably connected at the other end to an longitudinally extending threaded rod 82. Rod 82 extends through a longitudinally extending bore 84 in crossbar 78 and is threaded into an internal bore 86 in a tension adjusting bolt 88. Bolt 88 is slidably mounted in frame 62 and abuts crossbar 78 at one end. The other end of bolt 88 includes a knurled knob 90.

Located above members 68 and 70 of lever 60 is a first impact block 92 which is supported by frame 62. Impact block 92 is struck by lever 60 upon the counterclockwise rotation thereof. Located vertically below impact block 92 is a second impact block 94 which is struck by members 68 and 70 on the clockwise rotation of lever 60.

The embodiments of the invention shown in FIGS. 4 and 5 provides exercise to the operator upon both upward and downward rotation of handle 66. The operation of the exercising device is as follows. Assuming that lever 60 is located in its uppermost rotational position with members 68 and 70 abutting inpact block 94, pivot points 77 are located vertically below spring 80. The rotation of lever 60 about the fulcum point located at pin 64 is against the spring tension of spring 80 until pivot points 77 are vertically aligned with spring 80. Continued downward rotation of lever handle 66 moves pivot points 77 above spring 80, as shown in FIG. 5, and the spring tension restraining downward movement of lever 60 is changed to a spring tension aiding the downward movement. Thus, the spring force is added to the operator's force applied at handle 66 and members 68 and 70 are rapidly rotated into contact with impact block 92. The impact force is thereupon transferred through lever 60 to the operator providing him with isometric impact exercise. It is noted that during the downward movement of lever 60 tension adjusting bolt 88 moves longitudinally with respect to frame 62 and links 74 and 76 rotate about pivot point 79.

The tension in spring 80 is adjusted by the rotation of tension adjusting bolt 88 which changes the position of threaded rod 82 within internal bore 86 of bolt 88.

Figure 6:
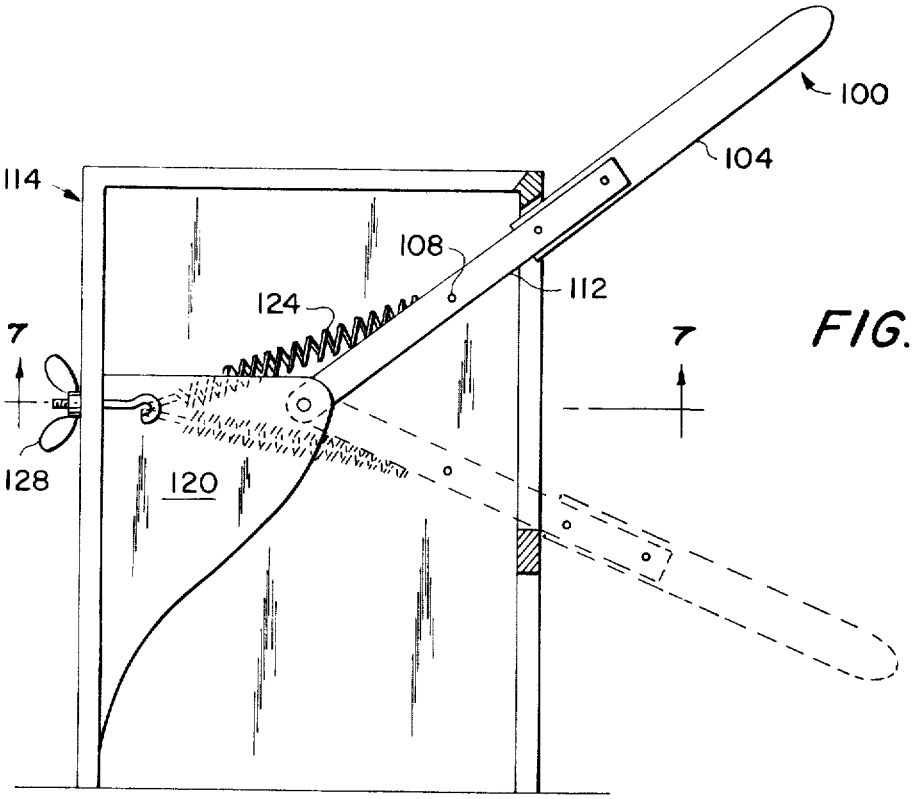
FIG. 6 is a top plan view of yet another embodiment of the invention.
Figure 7:
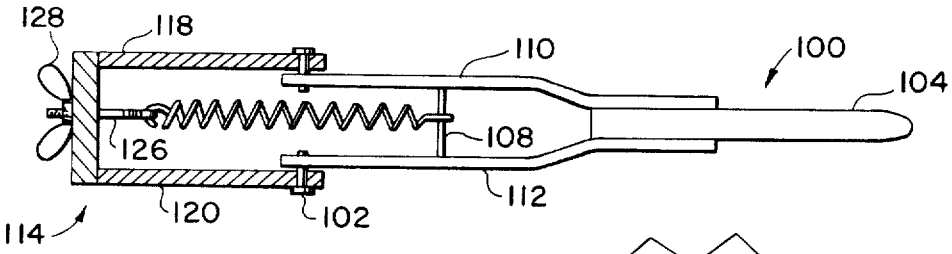
FIG. 7 is a side elevational view of the embodiment shown in FIG. 6.
Figure 8:
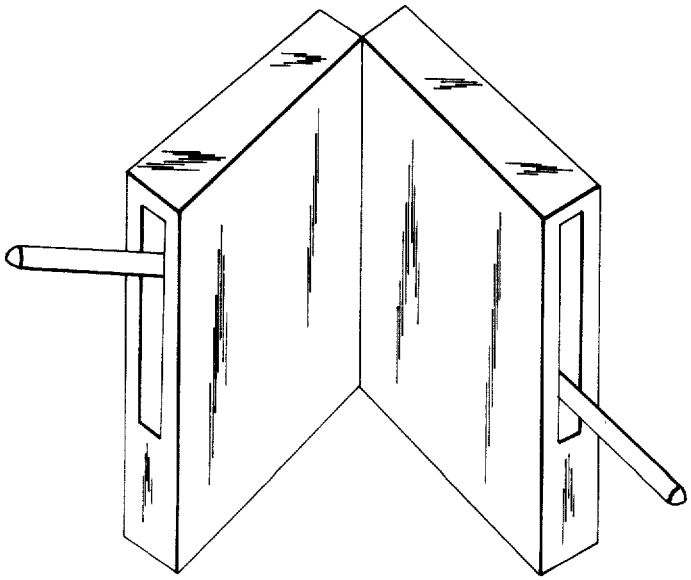
FIG. 8 is a perspective view showing two exercising devices of the embodiment shown in FIGS. 6 and 7 mounted in a folding stand.

A third embodiment of the present invention is shown in FIGS. 6 through 8 in which a third class lever is employed. A biforcated lever 100 has a fulcrum point 102 located at one end thereof, a handle 104 on which an operator applies a force, and a transverse pin 108 located between fulcrum 102 and handle 104 and to which a force resisting means can be attached. Lever 100 further comprises arms 110 and 112 which are attached at one end thereof to handle 104 and extend substantially colinearly therefrom. The exercising device of this embodiment further comprises a frame 114 which includes gusset plates 116 and 118 extending parallel from a back plate 120. Attached to the upper corners of gusset plates 116 and 118 are arms 110 and 112 respectively. Frame 114 further encludes an impact block 122 mounted on the front end of frame 114 a vertical distance below and a longitudinal distance from fulcrum 102.

The force resisting means comprises a coil spring 124 which is pivotably mounted at one end to transverse pin 108 and which is mounted at the other end to a hook shaped pin 126. Pin 126 is mounted on back plate 120 of frame 114 at a vertical distance substantially equal to the vertical distance of fulcrum 102 and is retained in place by a winged nut 128. As can be readily seen, the tension on spring 124 can be adjusted by adjusting winged nut 128.

The operation of the embodiment of the invention shown in FIG. 6 through 8 is substantially the same as the operation of the embodiment of the invention shown in FIGS. 4 and 5. It is further noted that a second impact block can be mounted on Frame 114 vertically above impact block 122 so that the exercising device can be used by rotating lever 100 in either an upward or a downward direction.

FIG. 8 depicts two exercising devices mounted in respective frames which are hinged together. With this particular type of device, an operator can exercise both limbs at the same time.

Other variations and modifications to an exercising device in accordance with the present invention should be obvious. Some of these modifications can include having a vertically adjustable impact block, having a horizontally or longitudinally adjustable impact block, and having an impact block which does not absolutely impede the downward motion of the operating lever. The latter type impact block can, for example, be mounted on a shock absorbing means and would therefore transmit to the operator a smaller impact that would extend over a longer period of time than the impact imparted by impact blocks depicted in the drawings. In addition, the fulcrum of the operating levers can be positionable in either a vertical or a longitudinal direction to provide further adjustments for the exercising device. In the presently preferred embodiments of the invention, both first and third class levers have been depicted, however, it should be obvious that an exercising device having a second class lever could be provided with obvious variations being made to the supporting frames.

It is noted that the figures depict embodiments of the present invention designed for exercising the arms and wrists. However, with obvious alterations or modifications, a devlce according to the present invention can be changed for exercising the legs and feet.

Although the invention has been described in detail with respect to an exemplary embodiment thereof, and some possible variations of the presently preferred embodiment have been described, it will be understood by those of ordinary skill in the art that still further variations and modifications may be effected within the scope and spirit of the invention.

What is claimed is:

1. An exercising and development apparatus for use with the limbs of an operator employing the principle of isotonic exercise combined with the principle of isometric impact exercise, comprising:

a force resisting means a lever for operating against said force resisting means, said force resisting means having a resistance selected such that the amount of force necessary to be applied to said lever by the operator thereof to overcome said resistance provides the limbs of the operator with isotonic exercise;

means for adjusting the force of said force resisting means;

means for releasing said lever from said force resisting means, and a travel restricting means for impeding the travel of said lever upon release from said force resisting means, said travel restricting means being located with respect to said lever so as to permit said lever to travel rapidly upon release of said force resisting means therefrom and so as to apply to the limbs of the operator isometric impact exercise when said lever strikes said travel restricting means.

2. The exercising apparatus as claimed in claim 1 wherein said lever is a first class lever operatively engaging said force resisting means at one end of said lever, and said lever comprises a force applying end, a central fulcrum and a force engaging end.

3. The exercising apparatus as claimed in claim 2 wherein said force resisting means comprises a compression spring and a movable member engaging said spring at one end thereof for compressing said spring when moved and wherein said one end of said lever engages and moves said movable member.

4. The exercising apparatus as claimed in claim 3 wherein said force resisting means further comprises a shaft concentrically mounted inside said spring and said and an adjustable member engaging the other end of said spring for adjusting the compression of said spring.

5. The exercising apparatus as claimed in claim 4 wherein said movable member is movable both axially along and rotationally about said shaft and comprises a first boss for engaging said one lever end and a second boss, and wherein said releasing means comprises a trip latch for engaging said second boss after a predetermined axial movement of said movable member and for rotating said movable member out of engagement with said lever, thereby releasing said lever from said force resisting means.

6. The exercising apparatus as claimed in claim 5 wherein said one lever end has a transversely inclined bevel on the side opposite the movable member engaging side, said bevel for rotating said movable member upon the resetting of said lever.

7. The exercising apparatus as claimed in claim 6 wherein the side of said movable member opposite the spring engaging side comprises an axially extending beveled surface and wherein said force resisting means further comprises a fixedly mounted collar having a contra-beveled surface engaging said beveled surface of said movable member for resetting the angular position of said movable member after said movable member has been rotated.

8. The exercising apparatus as claimed in claim 2 wherein said travel restricting means positively impedes the travel of said lever upon release from said force resisting means.

9. The exercising apparatus as claimed in claim 8 wherein said travel restricting means is located between the force applying end and the fulcrum of said lever.

10. Apparatus as set forth in claim 2 wherein said force resisting means is a coil spring concentrically mounted on a threaded rod having a nut capable of adjusting compression on said coil spring, said lever is a first class lever engaging said force resisting means through a cam concentrically mounted on said threaded rod, said cam engaging an oppositely beveled cam to cause rotation of said first cam in order to disengage said lever from the force resisting spring, and an impact block located to positively impede the travel of said lever after disengagement from the force resisting spring.

11. Apparatus as set forth in claim 1 for exercising the limbs of an operator and further comprising a frame on which said lever, said force restricting means, said releasing means and said travel restricting means are mounted; and a second lever with corresponding force restricting means, and releasing means and travel restricting means also mounted on said frame, thereby permitting exercising of both limbs of the operator.

12. The exercising apparatus as claimed in claim 1 wherein said lever is a biforcated first class lever having a first, force applying end, a centrally disposed fulcrum, and a second end for operating against said force resisting means, said lever comprising a handle portion and two elongate members rigidly connected to said handle portion and extending therefrom substantially parallel to each other, and wherein said force resisting means comprises a spring and means for connecting said spring to said second end of said lever between said elongate members such that upon rotation of said lever in a first direction said lever is initially opposing the force of said spring, said lever is in line with said spring, and finally said lever is aiding the force of said spring.

13. The exercising apparatus as claimed in claim 12 wherein each said elongate member of said lever comprises a first link rigidly connected at a first end to said handle portion and a second link pivotably connected at a first end thereof to the other end of said first link, and wherein said spring comprises an extensible coil spring connected at a first end thereof to the other end of said second link.

14. The exercising apparatus as claimed in claim 13 wherein the fulcrum of said lever is located at said first link and wherein other end of said coil spring is connected to said fulcrum at a location between said pair of first links.

15. The exercising apparatus as claimed in claim 14 wherein said lever further comprises a transverse cross bar pivotably connected to the other ends of said second links, said cross bar having a bore extending in a generally longitudinal direction completely therethrough; and wherein said force resisting means is adjustable and further comprises means for adjusting the force, said force adjusting means comprising a threaded rod which extends completely through said bore and a knob having a threaded bore into which a first end of said rod extends in positionable threaded engagement therewith, said first end of said spring being connected to the other end of said rod.

16. The exercising apparatus as claimed in claim 12 wherein said travel restricting means positively impedes the travel of said lever and is located so as to be struck by said elongate members.

17. The exercising apparatus as claimed in claim 16 wherein said travel restricting means comprises two members, one located above said elongate members, and one located below said elongate members.

18. The exercising apparatus as claimed in claim 1 wherein said lever is a third class lever comprising a force applying end, a central force engaging portion, and a fulcrum located at the other end.

19. The exercising apparatus as claimed in claim 18 wherein said force resisting means comprises a tension spring pivotably mounted at one end thereof to said central portion of said lever.

20. The exercising apparatus as claimed in claim 19 and further comprising a frame, and wherein said lever is biforcated and comprises a handle and two leg members connected at one end thereof to said handle, the other end of each said leg member being pivotably connected to said frame, said spring being pivotably connected between said leg members.

21. The exercising apparatus as claimed in claim 19 and further comprising means for adjusting the spring tension of said spring.

22. The exercising apparatus as claimed in claim 18 wherein said exercising apparatus further comprises a biforcated frame having a first section pivotably connected to a second section, said sections being substantially the same.

* * * * *